United States Patent [19]

Ikenoue et al.

[11] Patent Number: 4,457,995

[45] Date of Patent: Jul. 3, 1984

[54] LIQUID DEVELOPER CONTAINING DIPHATIC ALCOHOL FOR ELECTROSTATIC PHOTOGRAPHY AND DEVELOPMENT PROCESS USING THE SAME

[75] Inventors: Shinpei Ikenoue; Kazuo, Ishü; Akira Kashiwabara, all of Saitama, Japan

[73] Assignee: Fuji Photo Film Co., Ltd., Kanagawa, Japan

[21] Appl. No.: 423,372

[22] Filed: Sep. 24, 1982

[30] Foreign Application Priority Data

Sep. 24, 1981 [JP] Japan ..... 56-151160

[51] Int. Cl.[3] ..... G03G 9/12

[52] U.S. Cl. ..... 430/115; 430/137

[58] Field of Search ..... 430/11 S, 117, 119, 430/137

[56] References Cited

U.S. PATENT DOCUMENTS

| | | | |
|---|---|---|---|
| 3,885,960 | 5/1975 | Anderson | 430/112 X |
| 3,997,456 | 12/1976 | Voss | 430/115 |
| 4,024,292 | 5/1977 | Lu et al. | 430/115 X |

*Primary Examiner*—John D. Welsh

*Attorney, Agent, or Firm*—Sughrue, Mion, Zinn, Macpeak and Seas

[57] ABSTRACT

A liquid developer for electrostatic photography and a method of using it is disclosed. The developer is comprised of toner particles dispersed in a higher electrically insulating carrier fluid and at least one kind of aliphatic alcohol having 10 or more carbon atoms in an amount of 0.1 to 40 parts by weight per one part by weight of the toner particles. Even after repeated use the developer provides images having high quality and the sensitivity of the developer does not substantially change. The developer is preferably used in the production of electrophotographic offset printing plates.

19 Claims, No Drawings

LIQUID DEVELOPER CONTAINING DIPHATIC ALCOHOL FOR ELECTROSTATIC PHOTOGRAPHY AND DEVELOPMENT PROCESS USING THE SAME

FIELD OF THE INVENTION

The present invention relates to a liquid developer for developing electrostatic latent images formed by electrophotography, electrostatic printing, and electrostatic recording which are based on electrostatic photography. More particularly, it relates to a liquid developer which can be used repeatedly.

BACKGROUND OF THE INVENTION

Electrostatic photography is characterized by simplicity, rapidity, and a moderate price, and a liquid developer is advantageous in that it provides a high image quality. In order to obtain the advantages of both, the liquid developer should be such that it keeps the image quality and sensitivity with a minimal change even after repeated use. Usually, when a liquid developer is used repeatedly, the concentration of toner particles decreases and the developer changes in composition. This causes changes in image quality such as a decrease of image density, and change of gradation, and an increase of sensitivity of the developer. The change of sensitivity makes it necessary to adjust exposure. This detracts from the merits of electrophotography such as simplicity and rapidity. In addition, it becomes necessary to replace the developer frequently if the developer causes changes in the image quality or changes sensitivity to a large extent shortly after repeated use.

Since the currently available liquid developer greatly changes the image quality after repeated use, the developing unit is provided with an automatic control apparatus that maintains the same concentration of toner particles in the developing tank. However, the use of such an apparatus increases equipment cost, makes the equipment complex and vulnerable to troubles, and causes the equipment to need more maintenance. Thus, there has been a demand for a liquid developer that can be used repeatedly without cansing above-described problems.

SUMMARY OF THE INVENTION

It is an object of the present invention to provide a liquid developer for electrostatic photography which substantially maintains the same image quality even after repeated use.

It is another object of the present invention to provide a liquid developer for electrostatic photography which substantially maintains its sensitivity even after repeated use.

It is a further object of the present invention to provide a liquid developer for electrostatic photography applied to platemaking for electrostatic offset printing in which the developed toner image is used as the printing image (oleosensitive image).

Yet another object of the present invention is to provide a liquid developer for electrostatic photography which prevents the formation of a fogged or scummed area which produces fogging or scumming in the printed matter when the plate is used for offset printing.

The present invention resides in an improved liquid developer for electrostatic photography in which toner particles are dispersed in a highly electrically insulating carrier fluid. The liquid developer is characterised by containing an aliphatic alcohol having 10 or more carbon atoms in an amount of 0.1 to 40 parts by weight per one part by weight of the toner particles.

DETAILED DESCRIPTION OF THE INVENTION

The liquid developer of this invention may contain, in addition to the alcohol specified above, any components which constitute conventional liquid developers for electrostatic photography (disclosed in, for example, U.S. Pat. Nos. 3,788,995 and 4,052,325). If an aliphatic alcohol having less than 10 carbon atoms is used, the resulting liquid developer smells bad and the alcohol evaporates during storage. This evaporation changes the characteristics of the developer as used in connection with electrophotography. When added to the liquid developer of this invention, branched aliphatic alcohols are superior to linear aliphatic alcohols in that the liquid developer can be used repeatedly and the alcohol does not separate out at low temperatures. For the same reasons as above, the alcohols preferably have 14 or more carbon atoms, more preferably 17 or more carbon atoms. Usually, the carbon number does not exceed 32. Two or more alcohols may be used in combination.

Examples of aliphatic alcohols used in the liquid developer of this invention are listed below.

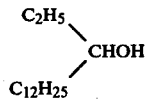

(1)

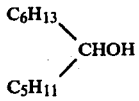

(2)

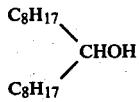

(3)

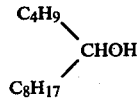

(4)

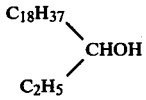

(5)

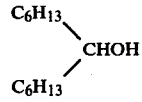

(6)

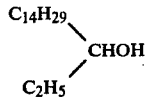

(7)

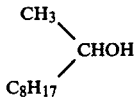

(8)

-continued (9) $(C_4H_9)(C_6H_{13})CHOH$

(10) $(C_4H_9)(C_{12}H_{25})CHOH$

(11) $(C_6H_{13})(C_8H_{17})CHOH$

(12) $(C_3H_7)(C_8H_{17})CHOH$

(13) $((CH_3)_2CH-CH_2)(CH_3(CH_2)_3CH(C_2H_5)(CH_2)_2)CHOH$

(14) $((CH_3)_3C-CH_2CH(CH_3)CH_2CH_2)((CH_3)_3C-CH_2CH(CH_3))CHCH_2OH$

(15) $(C_2H_5)(C_{12}H_{25})CHCH_2OH$

(16) $(C_6H_{13})(C_5H_{11})CHCH_2OH$

(17) $(C_8H_{17})(C_8H_{17})CHCH_2OH$

(18) $(C_4H_9)(C_8H_{17})CHCH_2OH$

(19) $(C_{18}H_{37})(C_2H_5)CHCH_2OH$

(20) $(C_6H_{13})(C_6H_{13})CHCH_2OH$

(21) $(C_{14}H_{29})(C_2H_5)CHCH_2OH$

-continued

22) $(C_8H_{17})(C_8H_{17})CHCH_2OH$

23) $(C_{12}H_{25})(C_{12}H_{25})CHCH_2OH$

24) $(C_4H_9)(C_{12}H_{25})CHCH_2OH$

25) $(C_6H_{13})(C_8H_{17})CHCH_2OH$

26) $(C_3H_7)(C_8H_{17})CHCH_2OH$

27) $(C_{14}H_{29})(C_8H_{17})CHOH$

28) $(C_{16}H_{33})(C_8H_{17})CHOH$

29) $(C_{14}H_{29})(C_8H_{17})CHCH_2OH$

30) $(C_{16}H_{33})(C_8H_{17})CHCH_2OH$ 31) n-$C_{10}H_{21}OH$ 32) n-$C_{12}H_{25}OH$ 33) n-$C_{14}H_{29}OH$

Toner particles composed of pigment particles and/or oleophilic polymer particles can be used for the liquid developer of this invention. The pigment particles may be either inorganic or organic.

Black pigments which have been found to be useful include carbon black, Aniline Black (Imperial Chemical Industries, Inc. in the U.K., abbreviated as I), Cyanine Black BX (Sumitomo Chemical Co., Ltd.), Mogul A (Cabot Corp., abbreviated as C), Spiron Black (Hodogaya Chemical Co., Ltd., abbreviated as H), Monolight Fast Black BX (I), and Spirit Black (Orient Kasei K.K., abbreviated as O).

Red pigments which have been found to be useful include Spiron Red (H), Spiron Orange (H), Benzine Orange (Sanyo Shikiso K.K., abbreviated as S), Brilliant Carmine 6B (S), Scarlet KR (S), Fast Red (S), Fast Rose 839 (Dainichiseika Color & Chemicals Mfg. Co., Ltd., abbreviated as D), and Monolight Fast Red B(I).

Yellow pigments which have been found to be useful include Spiron Yellow (H), Benzine Yellow GNN (S), Benzine Yellow 471 (D), and Monolight Fast Yellow IOG (I).

Blue pigments which have been found to be useful include Victoria Blue (H), Methylene Blue (H), Oil Blue (O), Alkali Blue (O), Sky Blue (S), Cyanine Blue FG (S), Cyanine Blue NSG (D), Phthalocyanine Blue, Lignol Blue NCB (Toyo Ink Mfg. Co., Ltd.), Monastra Fast Blue G (I), and Barifast Blue (O).

Green pigments which have been found to be useful include Phthalocyanine Green LL (S), Phthalocyanine Green LX (S), Seikalite Green Lake #4554 (D), and Chromofine Green G (D).

Spiron Violet (H) has been found to be useful as a violet pigment.

For development of transparent electrophotographic films, it is possible to use a white pigment such as barium sulfate, titanium oxide, zinc oxide, and magnesium oxide.

Oleophilic polymer particles are particles comprised of homopolymer or copolymer generally having a softening point of about 0° C. to about 150° C., preferably about 25° C. to about 120° C. Examples of such polymers include homopolymers and copolymers synthesized from vinyl acetate, acrylic ester, methacrylic ester, styrene, vinyltoluene, butylstyrene, and butadiene. They also include cyclized rubber, polyvinylbutyral, linear polyester (polydecamethylene sebacate, polyethylene sebacate). The polymer particles may be colored with a pigment or dye.

The highly electrically insulating carrier fluid is generally an organic fluid having an electrical resistance greater than $10^9\Omega$-cm, a dielectric constant lower than 3, and a boiling point higher than 90° C. Examples of such liquids include isoparaffin solvents such as Isopar G, Isopar H, and Isopar L (products of Esso Standard Oil), and aromatic hydrocarbons such as Solvesso 100, 150 and 200 (a product of Humble Oil & Refining Co.), hydrocarbon halogenides such as Freon (a product of E. I. du Pont de Nemours & Co., Inc.) and perchloroethylene.

An oleophilic resin is used as an auxiliary resin to keep toner particles dispersed stably and to improve fixation of toner particles. This auxiliary resin may be either soluble or insoluble in the highly electrically insulating carrier fluid. A resin which is insoluble in the carrier fluid may be used to coat pigment particles to form toner particles.

Examples of such an auxiliary resin includes rosin such as a hydrogenated rosin and an ester thereof; an iso-butyl methacrylate/n-butyl methacrylate copolymer, an alkyl (6 or more carbon atoms) methacrylate homopolymer and copolymer, a styrene/butadiene polymer and graft-copolymer formed in a non-aqueous solvent; a modified or unmodified phenolic resin; pentaerythritol phthalate; coumarone-indene resin; an ester gum resin; a vegetable oil-modified polyamide; and alkyd resins such as a soy bean oil-modified or linseed oil-modified alkyd resin, a phthalic acid resin, a maleic acid resin, and a styrenated alkyd resin.

The weight ratio of the total amount of the pigment and polymer particles to the auxiliary resin is preferably 1:0.05 to 10, and more preferably 1:0.1 to 5. The weight ratio of the total amount of the pigment and the polymer particles to the auxiliary resin which is insoluble in the carrier liquid is 1:0.05 to 4.

The carrier fluid is used in an amount of 30 to 1500 parts by weight, preferably 60 to 700 parts by weight, per 1 part by weight of the toner particles. The weight of the toner particles is the total weight of pigment, polymer particles, and auxiliary resin insoluble in the carrier fluid which are contained in the liquid developer.

According to this invention, the alcohol is added in an amount of 0.1 to 40 parts by weight, preferably 0.3 to 20 parts by weight, more preferably 0.5 to 10 parts by weight, per 1 part by weight of the toner particles. If the quantity added is less than specified above, the resulting liquid developer cannot be used repeatedly. If the quantity added is more than specified above, the resulting liquid developer decreases excessively in electrical resistance, resulting in a decrease of image density.

The liquid developer of this invention may be incorporated with an agent that controls the polarity of the charge on the toner particles. Examples of such a porality controlling agent include metal salts of resin acids such as rosin; metal salts of fatty acids such as oleic acid and stearic acid; metal salts of alkylbenzenesulfonic acids containing 2 to 12 carbon atoms; metal salts of alkylphosphoric acids containing 8 to 20 carbon atoms; metal salts of naphthenic acids; and metal salts of dialkylsulfosuccinic acids wherein each alkyl group contains 4 to 16 carbon atoms. The metal that constitutes the metal salt is preferably a polyvalent metal such as manganese, cobalt, nickel, and zirconium.

A polymer composed of monomers which act in order to control the polarity can also be used as the polarity controlling agent. Examples of such a polymer include homopolymers and copolymers composed of vinyl monomers such as unsaturated carboxylic acids (e.g., acrylic acid, methacrylic acid, fumaric acid, itaconic acid, crotonic acid, and maleic acid) and their amides; 2-hydroxyethyl acrylate, 2-hydroxyethyl methacrylate; 2-hydroxypropyl acrylate, 2-hydroxypropyl methacrylate, glycidyl acrylate, glycidyl methacrylate, styrene, vinyl acetate, acrylonitrile, methacrylonitrile, acrylamide, methacrylamide, and N-vinylpyrrolidone.

The charge polarity of the toner may also be controlled by lecithin or sorbitan ester.

The polarity controlling agent is preferably used in an amount of 0.0001 to 5.0 parts by weight, more preferably 0.001 to 2.0 parts by weight, per 1 part by weight of the toner particles.

The liquid developer of this invention may be produced by adding the specified alcohol during any stage of the production process employed for conventional liquid develpers. (Processes are described in, for example, U.S. Pat. Nos. 3,788,995 and 4,052,325). In one method, for example, the toner particles and an auxiliary resin may be mixed completely with a small quantity of carrier fluid to prepare a concentrated developer, which is then diluted with the carrier fluid. Where an auxiliary resin insoluble in the carrier fluid is used, the resin may be mixed completely with the toner particles in a solvent that solubilizes the resin and then the mixture may be diluted with the carrier fluid. Solvents which can be used to solubilize the resin including aromatic hydrocarbons such as benzene and toluene; hydrocarbon halogenides such as chloroform, methylene chloride and tetrachroethane; ketones such as acetone and methylethylketone; esters such as ethyl acetate and butyl acetate; and phenols such as phenol and m-cresol. The polarity controlling agent may be added during or after mixing. The alcohol may be added at any stage of these processes.

The liquid developer of this invention may be applied to any sensitive materials for electrophotography to which conventional liquid developers can be applied. Such sensitive materials are composed of a conductive substrate and a photoconductive layer formed thereon. The photoconductive layer is composed of an inorganic photoconductive material such as photoconductive zinc oxide or titanium oxide or a mixture thereof and an insulating binder. The photoconductive layer is also made of amorphous selenium or an organic photoconductive substance such as polyvinyl carbazole. The liquid developer of this invention exhibits its maximum effect in connection with a sensitive material containing zinc oxide.

The binder used for the sensitive material is a olephilic and insulating resin such as methacrylate resin containing methyl methacrylate, butyl methacrylate, hexyl methacrylate, or styrene; styrene-butadiene copolymer, styrene-modified alkyd resin; and silicone resin. In the photoconductive layer, the photoconductive substance and binder are used in the ratio of 1:1/10 to 1, preferably 1:1/5 to ½, by weight.

The photoconductive layer usually contains a spectral sensitizing dye such as Rose Bengal, Flurorescein, and Bromophenol Blue in an amount of about 0.1 to 10 mg per 1 g of the photoconductive substance.

The liquid developer of this invention can be used in the same way as conventional liquid developers. (They are disclosed in, for example, U.S. Pat. Nos. 3,788,995 and 4,052,325.) For example, development can be accomplished by dipping in the liquid developer an electrophotographic material having an electrostatic latent image.

The liquid developer of this invention is characteristic in that fogging does not increase and sensitivity of the developer does not change and consequently the image quality and image density remains stable even after the liquid developer has been used repeatedly.

After development with the liquid developer of this invention, the non-toner-deposited area on the photoconductive layer of the developed sensitive material may be converted to hydrophilic to prepare an offset printing plate. For conversion, any known conversion fluid may be used. For a sensitive material in which zinc oxide is used as the photoconductive substance, a solution containing potassium ferrocyanide, potassium ferrocyanide, ammonium phosphate chlorohexamminecoblat or magnesium salt of phytic acid may be used (disclosed in, e.g., U.S. Pat. Nos. 3,522,062, 3,672,885 and 4,053,319). The printing plate thus prepared is used for printing with an oil printing ink. Either a non-skin type ink (ink that does not form a film) or a skin type ink may be used. An oil printing ink which is generally used in such printing has a thickness of 8 to 30 at 20° C. measured in accordance with Japanese Industrial Standard-5701 (measured at a roller speed of 366 rpm).

The printing plate prepared by using the liquid developer of this invention is advantageous in that the image of fogging on the plate does not receive an oil printing ink and consequently it is not printed on paper. Thus, clear printed matter with no scumming and fogging can be obtained. This effect is remarkable particularly in the case of positive process development, although, it is also effective in the case of negative process development.

EXAMPLE 1 AND COMPARATIVE EXAMPLE 1

Liquid developer A (Comparative Example 1) and liquid developer B (Example 1) for electrophotography were prepared using the components as shown in Table 1.

TABLE 1

| Components of Liquid Developer | Unit: parts by weight Developer A (Comparative Example 1) | Developer B (Example 1) |
|---|---|---|
| (a) Carbon black (Elf-tex #8, a product of Cabot) | 10 | 10 |
| (b) 60% docosanylamide compound of diisobutylene/maleic anhydride copolymer | 0.1 | 0.1 |
| (c) Safflower oil-modified alkyd resin (oil length: 65%) | 20 | 20 |
| (d) Kerosene | 70 | 70 |
| (e) Alcohol represented by the formula (13) | nil | 2 |

The components (a) to (e) were mixed in a ball mill for 40 hours to prepare a concentrated pigment paste. Ten parts by weight of this paste was diluted with 1000 parts by weight of Isopar G to prepare the liquid developers A and B. They showed a positive charge.

The resulting liquid developers A and B were used for positive development with an ordinary wet type development unit for electrophotography. An image of good quality was obtained on electrophotographic sensitive paper having a sensitive layer which is composed of zinc oxide and a terpolymer of methylmethacrylate, butylmethacrylate and styrene and sensitized with Rose Bengal. The fog density was 0.06 in both cases of the liquid developers A and B.

Using the developing unit, the liquid develoeprs were compared for their life. Two hundred sheets of the above-mentioned electrophotographic sensitive paper (B5 size) were exposed and developed continuously with 500 ml of the developer A. (The original has a 10% black area.) The image reflection density (Dmax) was 1.5 in the first sheet, but it decreased to 1.0 in the 200th sheet. The same experiment as above was carried out for the developer B which contains the alcohol as represented by the formula (13). The image reflection density (Dmax) was 1.5 in the first sheet and 1.44 in the 200th sheet. The retention of image density was 67% for the developer A and 96% for the developer B. In addition, in the case of the developer B, fogging remained at 0.06 and very little streaks were observed throughout the entire 200 sheets. This result indicates that the addition of the alcohol represented by the formula (13) provides a developer which is exhausted very little even after repeated use.

EXAMPLE 2 AND COMPARATIVE EXAMPLE 2

Liquid developer C (Comparative Example 2) and liquid developer D (Example 2) for electrophotography were prepared using the components as shown in Table 2.

TABLE 2

| Components of Liquid Developer | Unit: parts by weight Developer C (Comparative Example 2) | Developer D (Example 2) |
|---|---|---|
| (a) Aniline Black | 4 | 4 |
| (b) 50% solution of lauryl methacrylate/acrylic acid copolymer (in Isopar H) | 40 | 40 |
| (c) Isopar H | 156 | 156 |
| (d) Alcohol represented by | nil | 1.5 |

TABLE 2-continued

| Components of Liquid Developer | Unit: parts by weight Developer C (Comparative Example 2) | Developer D (Example 2) |
|---|---|---|
| the formula (8) | | |

The components (a) to (d) were mixed in a homogenizer at 7000 rpm for 20 minutes to prepare a concentrated pigment paste. Ten parts by weight of this paste was diluted with 500 parts by weight of Isopar H to prepare the liquid developers C and D.

As in Example 1, the resulting liquid developers C and D (250 ml each) were used for positive development with an ordinary wet type developing unit. Development processing was carried out continuously for 100 sheets of electrophotographic sensitive paper (B5 size) having a sensitive layer composed of zinc oxide sensitized with Fluorescein and Bromophenol Blue and a binder of a copolymer of ethylenemethacrylate and styrene. (An original, B5 size, having a 10% black area was used). The optical density of the fogged area in the developed sensitive paper was 0.06 in both cases. However, during the continuous developing process, the reflection optical density (Dmax) decreased from 1.3 to 0.75 in the case of developer C and from 1.25 to 1.14 in the case of developer D. In other words, the developer D containing the alcohol represented by the formula (8) proved to have a long life, as in the case of the developer B in Example 1.

EXAMPLE 3

The same experiment as in Example 1 was carried out using the developer E incorporated with 2 parts by weight of alcohol represented by the formula (18) instead of alcohol represented by the formula (13). The developer E (500 ml) was used for positive development with a wet type developing unit. Development processing was carried out continuously for 200 sheets of electrophotographic sensitive paper (B5 size) having a sensitive layer of zinc oxide (sensitized with Rose Bengal) and a copolymer. The reflection optical density (Dmax) of the image decreased from 1.5 to 1.25, and the optical density of the fogged area was kept constant at about 0.06.

EXAMPLE 4 AND COMPARATIVE EXAMPLE 3

Liquid developer F (Comparative Example 3) and liquid developer G (Example 4) for electrophotography were prepared from the components as shown in Table 3.

TABLE 3

| Components of Liquid Developer | Unit: parts by weight Developer F (Comparative Example 3) | Developer G (Example 4) |
|---|---|---|
| (a) Alkali Blue (a product of Orient Kasei K.K.) | 5 | 5 |
| (b) Cottonseed oil | 20 | 20 |
| (c) Cobalt naphthenate | 0.05 | 0.05 |
| (d) Kerosene | 75 | 75 |
| (e) Alcohol represented by the formula (14) | nil | 5 |

The components (a) to (e) were mixed in a sand mill at 4500 rpm for 30 minutes to prepare a concentrated pigment paste. To prepare the liquid developers F and G, 10 parts by weight of this paste was diluted with 1000 parts by weight of a dispersion of Isopar G containing 0.1 part by weight of polyvinyl acetate particles prepared by emulsion polymerization of vinyl acetate.

As in Example 1, the resulting liquid developers F and G (250 ml each) were used for positive development with an ordinary wet type developing unit. Development processing was carried out continuously for 100 sheets of the electrophotographic sensitive paper. The reflection optical density (Dmax) of the image decreased from 1.3 to 0.6 in the case of the developer F and from 1.3 to 1.17 in the case of the developer G. The optical density of the fogged area was kept constant at about 0.06 throughout the development of 100 sheets in both cases of developers F and G. In the case of developer F, streaks were observed. However, in the case of developer G, streaks were not observed.

The developed electrophotographic sensitive paper (ZnO) was treated in the usual way with the conversion solution having the following formation to prepare a wet type offset master paper.

| | |
|---|---|
| Potassium ferrocyanide | 2.0 parts by weight |
| Ammonium dihydrogen phosphate | 8.0 parts by weight |
| Dipotassium ethylenediaminetetraacetate complex | 0.3 parts by weight |
| Glycerin | 15.0 parts by weight |
| Gum arabic | 0.2 parts by weight |
| Phenol | 0.5 parts by weight |
| Water | 74.0 parts by weight |

Using this master paper, offset printing was carried out. In the case of the master paper prepared by using the developer G, the fogged area of optical density 0.06, which was observed slightly in the master paper, did not attract oil printing ink at all, and consequently clean printing free of scumming was obtained. On the other hand, in the case of the master paper prepared by using the developer F, the fogged area of optical density 0.06, which was observed slightly in the master paper, attracted oil printing ink, and consequently printing with scumming was obtained.

These results indicate that the liquid developer of this invention is characterized by its ability to develope an offset master paper which does not print a fogged area.

EXAMPLE 5

The same experiment as in Example 1 was carried out using the developer H incorporated with n-myristyl alcohol represented by the formula (33) instead of the alcohol represented by the formula (13). The results are shown in Table 4.

TABLE 4

| Developer | First sheet Dmax | First sheet Fog | 200th sheet Dmax | 200th sheet Fog |
|---|---|---|---|---|
| A | 1.5 | 0.06 | 1.0 | 0.06 |
| B | 1.5 | 0.06 | 1.44 | 0.06 |
| H | 1.5 | 0.06 | 1.30 | 0.06 |

Each of the developers A, B and H resulted in developed images with fogging of optical density 0.06. The effect of adding n-myristyl alcohol is apparent when the developer is used repeatedly. However, the developer B containing a branched alcohol represented by the formula (13) is far superior in the performance during repeated use (image quality and change of sensitivity).

COMPARATIVE EXAMPLES 4 TO 8

Developers J, K, L, M, and N were prepared as in Examples 1 to 5 for developers B, D, E, G, and H, respectively, except that the alcohol was used in an amount similar than that specified in this invention. The results are shown in Table 5.

TABLE 5

| Comparative Example | Developer | Formula of alcohol | Quantity* per 1 part by weight of toner | First sheet Dmax | First sheet Fog | 200th sheet Dmax | 200th sheet Fog | Scumming in printing |
|---|---|---|---|---|---|---|---|---|
| 5 | J | (13) | 0.05 | 1.5 | 0.06 | 1.0 | 0.06 | Fogged area |
| 6 | K | (8) | " | " | " | " | " | was printed |
| 7 | L | (18) | " | " | " | " | " | as such in |
| 8 | M | (14) | " | " | " | " | " | all Comparative |
| 9 | N | (33) | " | " | " | " | " | Examples |

*parts by weight

It is to be noted from Table 5 that when the alcohol is used in an amount less than 0.1 part by weight per 1 part by weight of toner particles, the effect of this invention is not achieved. Thus, it is apparent that the present invention is entirely different from the liquid developer disclosed in Japanese Patent Publication No. 8756/1972, in the object of adding alcohol and the quantity of alcohol added. According to said Japanese Patent, alcohol is added in an amount of 0.001 to 0.005 part by weight per 1 part by weight of pigment, in order to prevent scumming.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising: toner particles selected from the group consisting of pigment particles and oleophilic polymer particles dispersed in a highly electrically insulating organic carrier fluid, the fluid having an electric resistance greater than $10^9\Omega$.cm and a dielectric constant lower than 3, and a branched aliphatic alcohol having 10 or more carbon atoms, the alcohol being present in an amount of 0.1 to 40 parts by weight per one part by weight of the toner particles, the organic carrier fluid being present in an amount from 30 to 1500 parts by weight per one part by weight of the toner particles.

2. A liquid developer as claimed in claim 1, wherein the branched aliphatic alcohol has 14 or more carbon atoms.

3. A liquid developer as claimed in claim 1, wherein the branched aliphatic alcohol has 17 or more carbon atoms.

4. A liquid developer as claimed in any of claims 2 or 3 wherein the branched aliphatic alcohol has 32 or less carbon atoms.

5. A liquid developer as claimed in claim 1, wherein the branched aliphatic alcohol is present in an amount of 0.3 to 20 parts by weight per 1 part by weight of toner particles.

6. A liquid developer as claimed in claim 1, wherein the branched aliphatic alcohol is selected from the group consisting of the alcohol represented by the formulas (1) to (30) below,

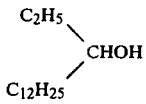
(1)

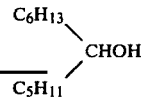
(2)

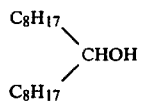
(3)

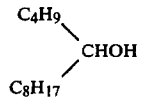
(4)

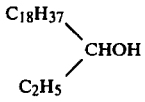
(5)

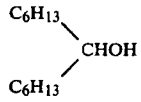
(6)

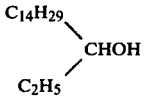
(7)

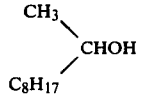
(8)

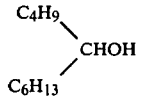
(9)

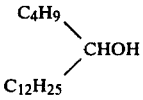
(10)

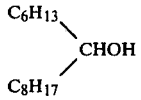
(11)

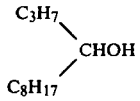
(12)

-continued (13)

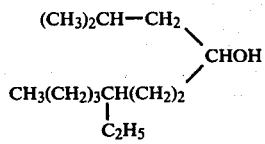

(14)

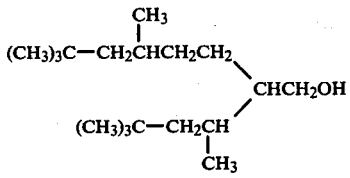

(15)

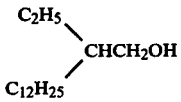

(16)

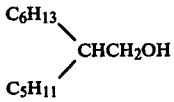

(17)

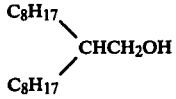

(18)

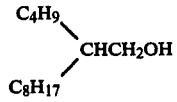

(19)

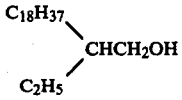

(20)

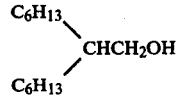

(21)

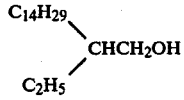

(22)

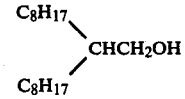

(23)

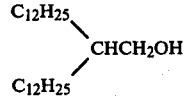

(24)

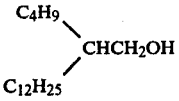

(25)

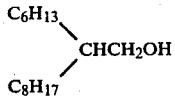

-continued (26)

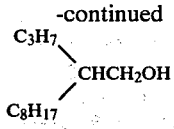

(27)

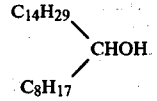

(28)

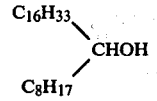

(29)

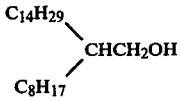

(30)

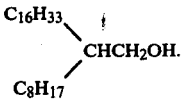

7. A liquid developer as claimed in claim 1, wherein the developer contains an oleophilic auxiliary resin capable of improving the dispersion of the toner particles in the carrier fluid.

8. A liquid developer as claimed in claim 1, wherein the developer contains an oleophilic auxiliary resin capable of improving fixation of the toner particles.

9. A liquid developer as claimed in claim 7, wherein the weight ratio of the total amount of pigment particles and polymer particles to the auxiliary resin is 1:0.05 to 10.

10. A liquid developer as claimed in claim 9, wherein the oleophilic auxiliary resin is insoluble in the carrier fluid and the weight ratio of the total amount of pigment particles and polymer particles to said auxiliary resin is 1:0.02 to 4.

11. A liquid developer as claimed in any of claims 7 or 8, wherein the auxiliary resin is insoluble in the carrier fluid and the toner particles are coated with said auxiliary resin.

12. A liquid developer as claimed in claim 1, wherein the developer contains a charge polarity controlling agent.

13. A liquid developer as claimed in claim 12, wherein the charge polarity controlling agent is contained in an amount of 0.0001 to 5.0 parts by weight per 1 part by weight of the toner particles.

14. In a development method for electrostatic photography wherein the electrostatic latent image is developed using a liquid developer comprising toner particles selected from the group consisting of pigment particles and oleophilic polymer particles dispersed in a highly electrically insulating carrier fluid, the fluid having an electric resistance greater than $10^9\Omega$.cm and a dielectric constant lower than 3, and a branched aliphatic alcohol having 10 or more carbon atoms, the alcohol being present in an amount of 0.1 to 40 parts by weight per one part by weight of the toner particles, the organic carrier fluid being present in an amount of from 30 to 1500 parts by weight per one part by weight of the toner particles.

15. A development method for electrostatic photography as claimed in claim 14, wherein the electrostatic latent image to be developed is formed on a photoconductive layer composed of an inorganic photoconductive substance and an insulating binder.

16. A liquid developer as claimed in claim 1, wherein the developer is for positive process development.

17. A development method for electrostatic photography as claimed in claim 14, wherein the development is a positive process development.

18. A liquid developer as claimed in claim 8 wherein the oleophilic auxiliary resin is selected form the group consisting of rosin; an iso-butyl methacrylate/n-butyl methacrylate copolymer, an alkyl (6 or more carbon atoms) methacrylate homopolymer or copolymer, a styrene/butadiene polymer or graft-copolymer thereof formed in a non-aqueous solvent; a modified or unmodified phenolic resin; pentaerythritol phthalate; a coumarone-indene resin; as ester gum resin; a vegetable oil-modified polyamide; and alkyd resins.

19. A liquid developer as claimed in claim 18, wherein said rosin is a hydrogenated rosin or an ester thereof and said alkyd resins are selected from the group consisting of a soy bean oil-modified or linseed oil-modified alkyd resin, a phthalic acid resin, a maleic acid resin, and a styrenated alkyd resin.

* * * * *